US006972512B2

(12) United States Patent
Hsiao et al.

(10) Patent No.: US 6,972,512 B2
(45) Date of Patent: Dec. 6, 2005

(54) FIELD EMISSION DISPLAY WITH REFLECTION LAYER

(75) Inventors: Chi Hung Hsiao, Taipei (TW); Jin-Shou Fang, Taipei (TW); Kuei-Wen Cheng, Taipei (TW)

(73) Assignee: Teco Nanotech Co., LTD, Taipei (TW)

( * ) Notice: Subject to any disclaimer, the term of this patent is extended or adjusted under 35 U.S.C. 154(b) by 57 days.

(21) Appl. No.: 10/792,844

(22) Filed: Mar. 5, 2004

(65) Prior Publication Data

US 2005/0194886 A1 Sep. 8, 2005

(51) Int. Cl.[7] ..... H01J 61/38; H01J 19/24

(52) U.S. Cl. ..... 313/113; 313/494; 313/497; 313/309; 313/336; 313/351

(58) Field of Search ..... 313/495–497, 313/309, 336, 351, 113; 315/169.4; 345/47, 345/60, 75

(56) References Cited

U.S. PATENT DOCUMENTS

| | | | | |
|---|---|---|---|---|
| 6,181,061 | B1 * | 1/2001 | Inoue | 313/495 |
| 6,674,242 | B2 * | 1/2004 | Kastalsky et al. | 315/169.3 |
| 6,727,642 | B1 * | 4/2004 | Cho et al. | 313/496 |
| 2005/0082964 | A1 * | 4/2005 | Konishi | 313/497 |

FOREIGN PATENT DOCUMENTS

| | | |
|---|---|---|
| TW | 289126 | 2/1993 |

* cited by examiner

*Primary Examiner*—Ashok Patel
(74) *Attorney, Agent, or Firm*—Troxell Law Office, PLLC

(57) ABSTRACT

A field emission display with reflection layer has an improved insulating supporting device. The major feature is to place a reflection layer on the insulating supporting device. From the special structure, the insulating supporting device can enhance the emission efficiency of the phosphors powder rather than the primary function of the insulating support. The field emission display with reflection layer has an anode structure, a cathode structure and the supporting device.

10 Claims, 4 Drawing Sheets

FIELD EMISSION DISPLAY WITH REFLECTION LAYER

FIELD OF THE INVENTION

The present invention relates to the structure of a field emission display. The feature is related to the reflection layer settled on the insulating supporting device between the cathode and the anode with a special effect of raising the brightness of the field emission display.

BACKGROUND OF THE INVENTION

There are various kinds of flat panel display (FPD) including, for example, field emission display (FED), liquid crystal display (LCD), plasma display panel (PDP), organic light emitter device (OLED), and liquid crystal projection display. The common features of such displays are that they are thin and light weight. According to the property of every flat panel display, some of them can be applied on the small scale panel for devices such as cellular phones; only a few are suitable for application in medium or large scale devices such as computer monitors or TV displays. Yet another application for flat panel displays further comprises super large scale display device such as an outdoor digital exhibition board. But the technologies of every kind of flat panel display are all progressing toward the object of high display quality together with large scale display and extended service life for application.

One of the rising new technologies for display is the field emission display developed in the recent years. The major feature is its self-emitting ability, which makes it superior to the LCD (lacking a self-emitting ability). Further the other benefits of large watching angle, low power consumption, high response efficient and the wide operation temperature can achieve the display quality like a traditional cathode ray tube (CRT). But the FED is lighter and thinner than the CRT. In addition, the recently developed new technology of nano-carbon-tube to be used on the FED area can promote the development of the FED.

A traditional three-electrodes FED 1*a* is shown in FIG. 1. The structure comprises at least an anode structure 10 and a cathode structure 20 in a structure unit. The insulation supporting device 15 (or spacer) is settled between the anode structure 10 and the cathode structure 20 as the boundary device in the vacuum environment and the support between the anode structure 10 and the cathode structure 20. Reference is made to FIG. 1, in which an anode structure 10 comprises at least an anode glass-plate 11, an anode conductive layer 12, and a phosphors layer 13. A cathode comprises at least a cathode glass-plate 21, a cathode conductive layer 22, an electron emitting layer 23, a dielectric layer 24, and a gate electrode layer 25. The insulating supporting device 15 acting as boundary device can arrange the location of the anode structure 10 and the cathode structure 20 to maintain the vacuum area between the anode structure 10 and the cathode structure 20. The anode conductive layer 12 can provide high voltage to induce the electron emitting layer 23 to generate electrons for emission to the phosphors layer 13 of the anode to excite the phosphors layer 13 to generate light. Thus, for the electrons moving in the FED, a vacuum pumping device induces a vacuum level of $10^{-7}$ torr in a FED to provide a good moving path for the electrons. Also, pollution of and chemical reaction on the electron emitting layer 23 or the phosphors layer 13 should be avoided. In order to push the electrons with enough power to strike to the phosphors layer 13 to produce sufficient light radiation, a suitable gap between the cathode structure and the anode structure should be maintained to let the electrons to generate sufficient acceleration.

The above-described FED, however, excites the phosphors layer 13 to radiate light at a low voltage. The anode voltage is generally applied below 5 KV and this is very little compared to the anode voltage (at least higher than 20 KV) of the anode of CRT. So the emitting energy of the electrons of the cathode is still limited and the lighting brightness is limited, as well. For the brightness issue is also being presented, such as high density of nano-carbon-tube for raising the electrical current density, high efficiency low voltage phosphors layer, and the improvement of driving electrical circuit. One of the useful method is to set a reflection layer 14 to raise the radiating efficiency of the phosphors layer.

The above-mentioned method of reflection layer can be illustrated by a certain CRT application. The electron emitter has a certain distance to the anode screen. For example, from referring to the conventional 17-inch CRT, the certain distance is at least 200 millimeters. The certain distance allows speed of the electrons from the cathode to be enhanced and to strike to phosphors layer with 20 KV. Regarding the raised emission efficiency and the uniformity of the phosphors layer 82, reference is made to FIG. 7 to illustrate the metal reflection layer 84 being coated on the phosphors layer 82 on the glass plate 80. The coated metal reflection layer 84 can reflect light deflected or reverse-emitted by the phosphors layer 82. The structure of the anode has the black block array 81 and the metal mask 83 controls emission of the electron beam 85. But from observing the structure of FED, the voltage applied on the anode is usually beyond 5 KV and the distance between the anode and the cathode is usually a few millimeters or less. Thus the electron emitting layer 23 can only emit low energy (lower than the CRT electron emitting energy) electrons. If the same method of coating the metal reflection layer 84 on the anode structure (with the phosphors layer) of the FED, as in the conventional CRT, is used, the electrons cannot fully penetrate the metal reflection layer 84 to emit light. In addition, the electron power in the FED is reduced by the metal reflection layer to cause the low radiating efficiency (of light) of the phosphors layer.

For the above reason, another conventional technique from the Taiwan Patent in Pub. No. 289126 discloses a special structure in FIG. 2. The said special structure includes the anode glass plate 91 to carry the phosphors powder layer 93, anode conductive layer 95 and the black block array 94. The supporting device 96 (having the supporting function between the anode and cathode) has the reflection layer 92 attached on the surface facing the phosphors powder layer 93. The reflection layer 92 can reflect the deflected light or reverse-emitted light generated from the phosphors powder layer 93. In particular, the reflection layer 92 is not directly attached to the phosphors powder layer 93. The said reflection layer 92 structure arrangement can raise the brightness by not absorbing the electrons. But the whole process of the technique in FIG. 2 is by the method of exposure with developing-out and the complex thin film process is applied by high equipment cost. In addition, the 20 inches display panel is difficult to manufacture by the special structure of the thickness in 500 $\mu$m. So the application area of display panel is in need of a simple and easy application method.

In recent years, a new style of support device in the display panel is frequently applied in the LCD display panel as a layer separating device. FIG. 5 shows the structure of the supporting device provided by the thermal expansion modulus similar to that of glass. The thickness of the whole display panel is from about 500 μm to 1500 μm. A plurality of holes 42 can be also etched in the supporting device. The holes have the diameter size to match the array cell requirement on the anode or cathode. The supporting device also can act as the device to support the whole structure between the anode and the cathode. Since the FED contains a vacuum area inside, the two panels of the anode and the cathode prevent collapse thereof. The conventional supporting device of the FED usually employs glass balls, cross-shaped glass or glass strips. The supporting devices bind the anode and the cathode to the supporting device with a fixing chemical in a binding process. The fixing chemical is applied in the binding process by sintering. For an FED image display, the scale of the supporting device is usually maintained of 50 μm to 200 μm. The outline dimension of the supporting device is very small and causes complications described as follows.

First, since the conventional supporting devices are small, the location arranging machine must be highly precise, which makes location of the supporting device very difficult. Second, the supporting device may cause pollution by the attachment of the fixing chemical since the conventional supporting device must touch the fixing chemical to attach to the display panel. The next process is to heat the panel to fix the display panel. But the attachment process may contaminate the display panel. In addition, the sintering process on the display panel may cause the fixing chemical to evaporate and further contaminate the display panel. From the description of these shortcomings of the conventional supporting device, it is evident that a new device should be developed to resolve the above problems and reduce the manufacturing cost.

The inventor has developed a new structure by modify the insulating supporting device 38 with coating a reflection layer 44. The modification provided by the inventor supports between the anode and the cathode and enhances the brightness of the phosphors layer. Additionally, the settling cost of the present invention is low because the process is simple. The conventional machine for the location arrangement of the supporting device is not required.

SUMMARY OF THE INVENTION

The prior art uses a low actuating power voltage of less than 5 KV. This is the major reason for the low efficiency of the phosphors layer. The conventional technical uses the reflection layer to raise the lighting efficiency, but the manufacturing process is very complex. In addition, in another conventional technique, contamination of the display panel is not easily prevented. The present invention thus provides a new insulating supporting device 38 with the reflection layer to raise the lighting efficiency of an FED. The installation process of the insulating device of the present invention is very easy. The insulating device of the present invention is also easy to manufacture independently with a low failure rate in quality.

The major purpose of the present invention is to provide an insulating supporting device 38 to raise the brightness of the FED.

Another purpose of the current invention is to provide a manufacturing method of an insulation supporting device 38 with the reflection layer. The insulation supporting device 38 can be manufactured independently and then installed in the FED by packaging.

The further purpose of the present invention is to provide a packaging method for an insulation supporting device 38 with the reflection layer. The insulation supporting device 38 can be applied in an FED without affecting the air guiding path and to fit the vacuum packaging process.

The structure of the present invention of field emission display with the reflection layer comprises an anode structure having a phosphors layer, a cathode structure having a nano-carbon-tube layer and an insulation supporting device located between the anode structure and cathode structure. The reflection layer faces the phosphors layer to reflect the light emitted from the phosphors layer.

BRIEF DESCRIPTION OF DRAWINGS

The various objects and advantages of the present invention will be more readily understood from the following detailed description when read in conjunction with the appended drawings.

DETAILED DESCRIPTION OF THE INVENTION

Figure 4:
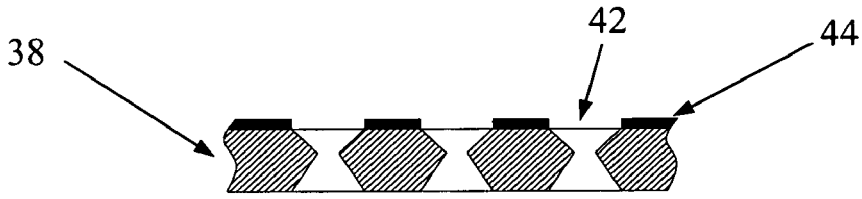
FIG. 4 shows a schematic view of the supporting device with the reflection layer according to the present invention.
Figure 5:
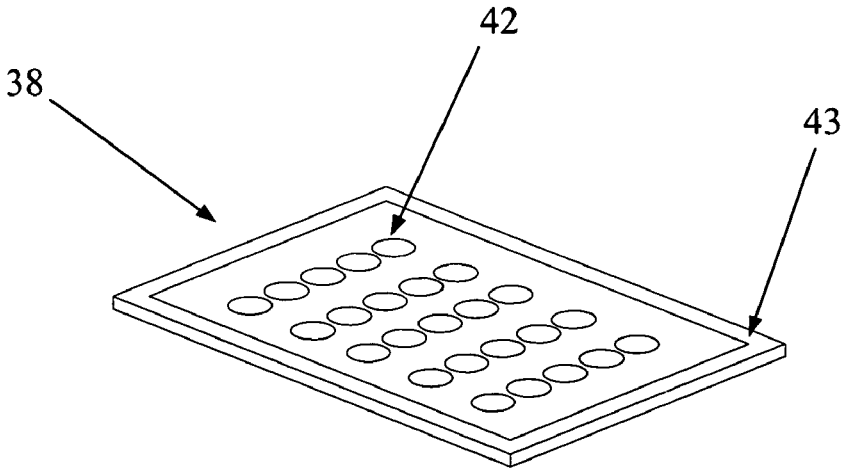
FIG. 5 shows a schematic view of the insulating supporting device in panel shape according to the present invention.

The present invention provides an insulation supporting device 38 with a reflection layer. Reference is made FIG. 5, in which the insulation supporting device 38 is made of an insulating material with a thermal expansion modulus similar to that of the anode structure (plate shape) or the cathode structure (plate shape). The said similar thermal expansion property can be useful when the heating process is applied to the FED panel, avoiding an expansion difference that would crack the FED panel surface. The said insulation supporting device 38 has a plurality of holes 42 that is arranged according to the cells of the anode structure or the cathode structure. The holes can act as the tunnels for the electrons from the cathode to pass through to strike the anode. The holes are formed by, for example, etching. For the special feature of the invention, a reflection layer 44 is installed on one side of the insulation supporting device 38. Reference is also made to FIG. 4 to illustrate the smooth, mirror-like surface serving as the reflection layer 44, of which the material is, for example, a conductive material. An alignment mark can be made on the extra side 43 for the vacuum package of the FED display panel and the cells of anode/cathode structure can face the holes 42 of the insulation supporting device 38. Additionally, a brushing area for the fixing chemical, to bind the anode structure and the cathode structure through the sintering process, can be designated on the extra side 43.

The manufacturing method of the present invention is described as follows. First, the insulation supporting device 38 with a plurality of holes therein is formed by spluttering or evaporating a reflection layer 44 on one side of the insulation supporting device 38. The main feature of FED of present invention can thus be produced by the above method.

The major feature of the present invention is insulation supporting device 38 and its assembly method is not the same as that of the conventional method in which it is directly inserted into the gap between the anode and the cathode. The assembly method according to the present invention adds an interference rib 39 on the side of cathode structure 20 (with the electron emitting layer 36) or anode structure 10 (with the phosphors layer 41). The interference rib 39 is formed to relate to the connection area between the holes of the insulation supporting device 38 for the function of additional support to provide an air or vacuum-flowing gap for the FED panel package. The air gap allows the residual air to escape from the cells (or the holes of the insulation supporting device 38) of the anode or the cathode during the packaging process of the FED. Another important assembly method is to attach the fixing chemical to the extra area 43 of the FED panel. The fixing chemical includes organic glue and binding material. The organic glue is for temporary fixing and the binding material is for binding the FED panel through sintering. The assembly process of the insulation supporting device 38 is to fix it between the anode and the cathode then to perform a heating process for sintering. The binding material can be the general glass glue to be applied in the sintering process for the binding of anode and the cathode. In addition, the alignment mark is designated to be formed on the insulation supporting device 38 to calibrate the position of the anode structure 10, cathode structure 20, and the insulation supporting device 38. The reflection layer 44 of the insulation supporting device 38 is formed on the side to face the phosphors layer 41 of the anode structure 10. From the application of the alignment mark, the cell in the cathode and the anode can fit the position of the holes on the insulation supporting device 38. Then the organic glue temporarily secures the calibrated components. Finally, the sintering process is performed on the fixing calibrated components by heating at a high temperature to bind the insulation supporting device 38 to the cathode structure 20 and the anode structure 10.

The electron emitting layer 36 (nano-carbon-tube layer), is described with the following application as the embodiment.

Figure 1:
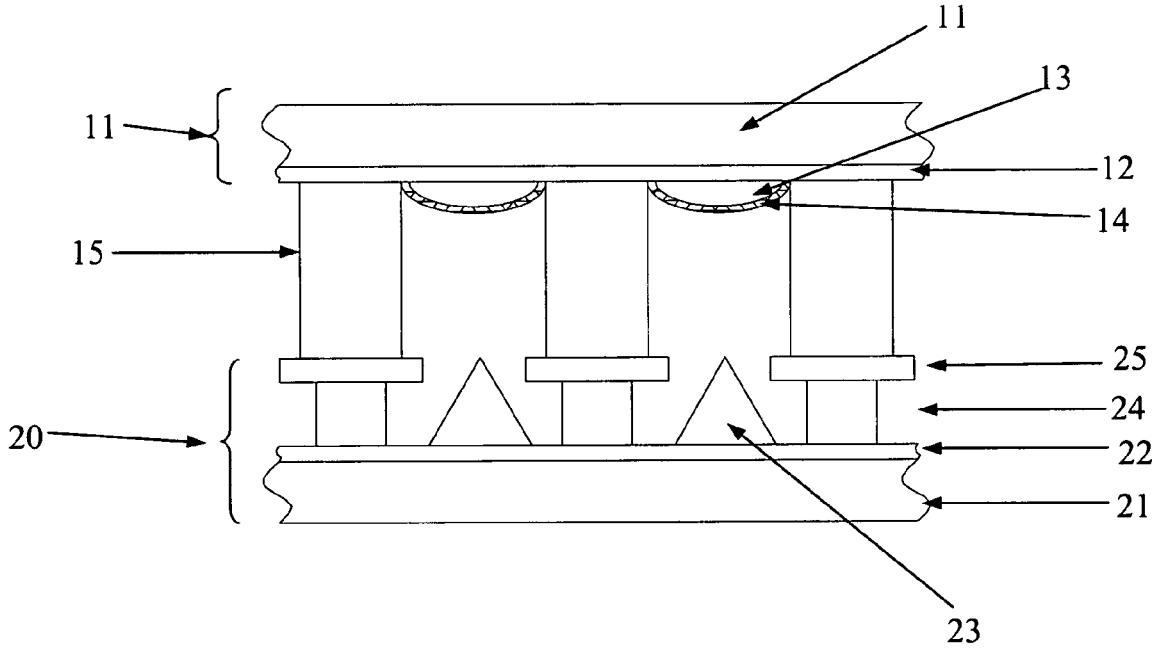
FIG. 1 PRIOR ART
FIG. 1 shows a schematic view of the structure of a first prior art for the field emission display with three electrodes.
Figure 6:
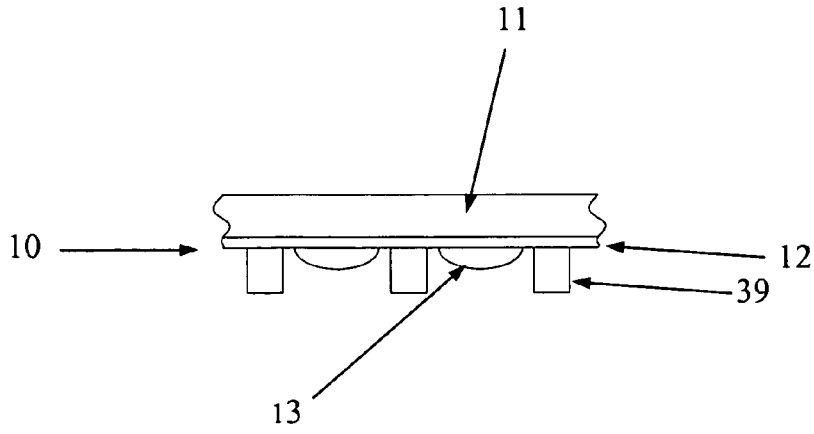
FIG. 6 shows a schematic view of the partial anode structure of the present invention.
Figure 7:
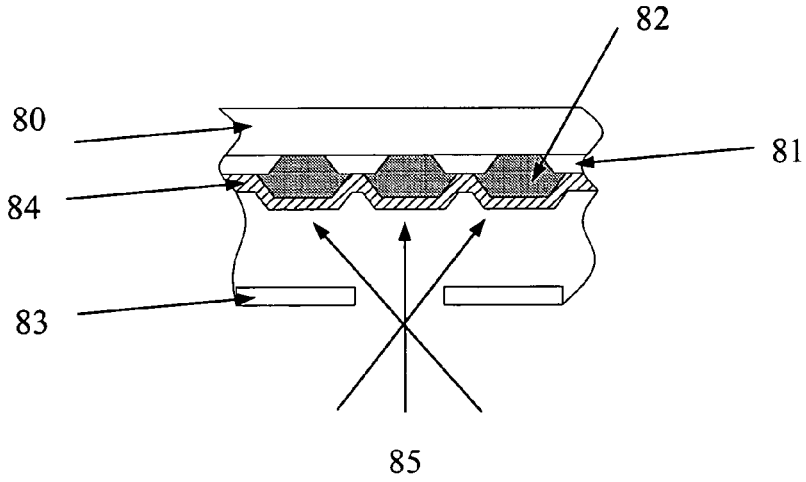
FIG. 7 PRIOR ART
FIG. 7 shows a schematic view of the partial anode structure of the prior art.
Figure 2:
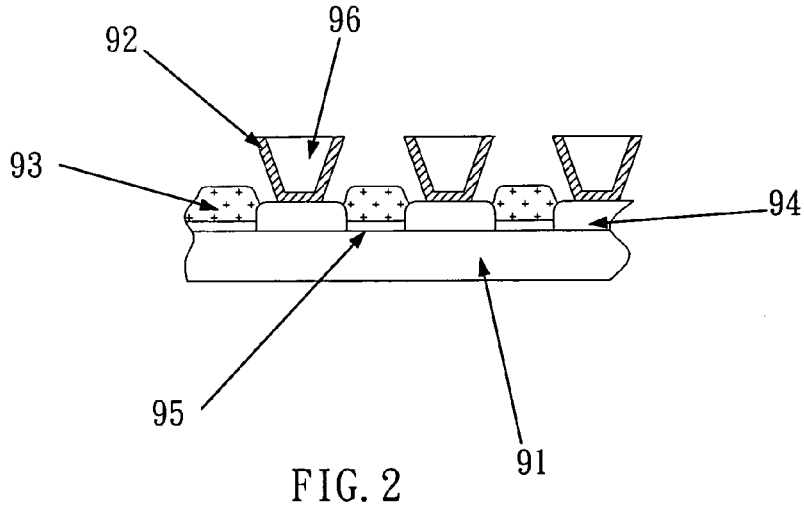
FIG. 2 PRIOR ART
FIG. 2 shows a schematic view of the supporting device of a second prior art for field emission display.
Figure 3:
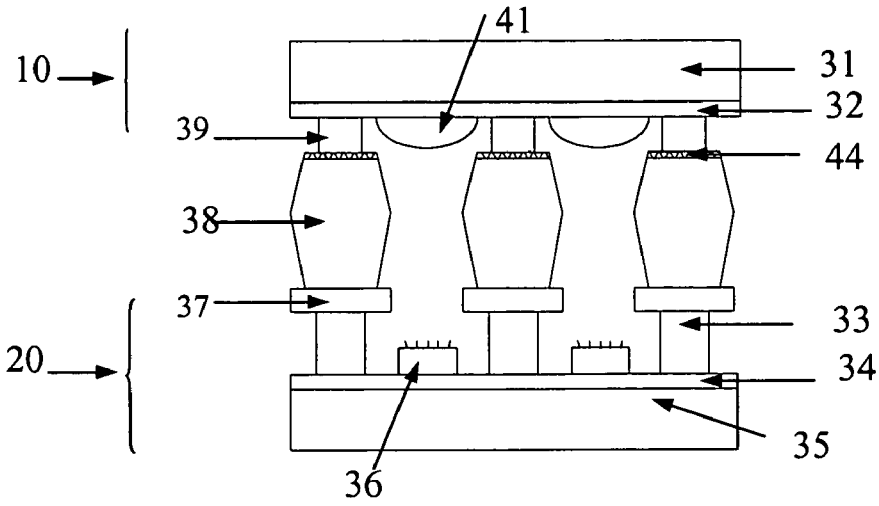
FIG. 3 shows a schematic view of the structure of the present invention.
Figure 8:
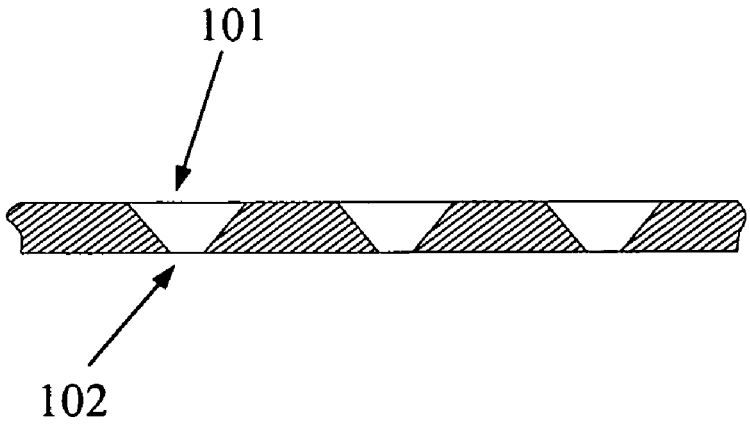
FIG. 8 shows a schematic view of the holes arrangement of the supporting device of the present invention.
Figure 9:
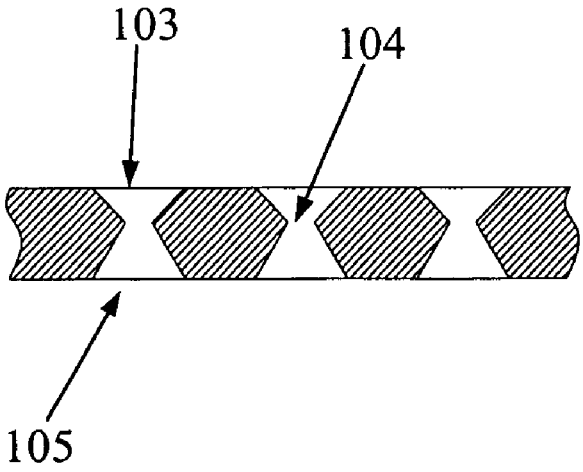
FIG. 9 shows a schematic view of the holes arrangement of another supporting device of the present invention.

The insulation supporting device 38 of the present invention can be made of the glass material with a thermal expansion modulus of $82\times10^{-7}$–$86\times10^{-7}$/° C, which is similar in range to that of the expansion modulus of the cathode plate 35 and anode plate 31. The outline dimension of the insulation supporting device 38 is designated by the FED panel size and multiple alignment marks are usually formed to fit the anode structure 10 and the cathode structure 20 at calibration. The holes in the insulation supporting device 38 are arranged relative to the cells array of anode structure 10 and the cathode structure 20. Reference is also made to FIG. 8 and FIG. 9, which provide a cross-sectional view of the chemically-etched holes as two types of the hole section. FIG. 8 shows that the first hole diameter 101 is larger than the second hole diameter 102. FIG. 9 illustrates another embodiment for the holes section, in which the third hole diameter 103 and the fifth hole diameter 105 are larger than the fourth hole diameter 104. In addition, the second hole diameter 102 and the fourth hole diameter are larger than the cell width of the electron emitting layer 36. Further, the reflection layer is located on the side of first hole in FIG. 8. In the embodiment illustrated in FIG. 9, however, the reflection layer is located on one of the two sides. The reflection layer of the insulation supporting device 38 can be generated by the evaporation of aluminum or chromium. The thickness of the insulation supporting device 38 is, for example, about 700 μm and the thickness of the reflection layer is, for example, about 80–500 nm. The extra area 43 of the insulation supporting device 38 is designed to have a glue brushing area and the fixing material deposing area. The glue brushing area is brushed with UV glue of the organic type for temporary fixing. Glass glue is deposited as the binding material on the fixing material deposition area. The assembly process for the FED uses the alignment mark to assemble the cathode structure 20, anode structure 10, and the insulation supporting device 38. The reflection layer 44 of the insulation supporting device 38 is located on the side of the anode structure 10 to face the phosphors layer 41. Additionally, a plurality of interference ribs 39 can be installed on the side of the anode structure 10. The interference ribs 39 are made of the glass with a thickness of about 50 μm to 150 μm to cause a gas communication area for the FED panel packaging. The interference ribs 39 are thus installed between the holes of the insulation supporting device 38. Packaging is performed by irradiating the UV glue with UV light to secure temporarily the panel and then sintering the temporarily fixed panel. FIG. 3 illustrates the whole structure of the present invention and FIG. 6 provides a partial structure of the anode structure 10 of the FED panel. The anode plate 31 has the phosphors layer 41 on the anode conductive layer 32. The interference rib 39 can be properly distributed on the side of the phosphors layer 41 to provide support and to let the air (vacuum) flow. The interference ribs 39 are not, however, installed on every cell of the anode structure 10. The insulation supporting device 38 has the reflection layer 44 on it. As illustrated in FIG. 3, the cathode structure 20 also has the dielectric period 33 with the gate electrode layer 37 thereon to provide the ability to accelerate the electrons. The cathode plate 35 has the cathode conductive layer 34 to receive the electrons emitting layer 36 (nano-carbon-tube layer).

The basic structure of the present invention is described as comprising an anode structure 10 having a phosphors layer 41, a cathode structure 20 having the nano-carbon-tube layer 36 (electrons emitting layer 36) and an insulation supporting device 38 located between the anode structure 10 and cathode structure 20. The reflection layer 44 faces the phosphors layer 41 to reflect the light emitted from the phosphors layer 41.

Various embodiments will be described in the following. The cathode structure 20 may comprises the gate electrode layer 37 between the nano-carbon-tube layer 36 and the insulation supporting device 38. Additionally the phosphors layer 41 can be formed by screen printing or spray coating. The nano-carbon-tube layer 36 is formed by screen printing or spray coating (by spray nozzle) as well. The nano-carbon-tube layer 36 comprises the property-improved (with a high degree of electron emitting efficiency) nano-carbon tube. In addition, the insulation supporting device 38 has a plurality of holes 42 and every nano-carbon-tube layer 36 in cell shape is placed in the holes 42. The present invention can further comprising an interference rib 39 placed in the insulation supporting device 38 and the anode structure 10; the interference rib 39 forms many air (vacuum) communication paths connecting to every of the holes 42. The reflection layer 44 can also be made of aluminum or chromium. For uniform expansion, the insulation supporting device 38 is made of glass with a thermal expansion modulus of about $82\times10^{-7}$–$86\times10^{-7}$/° C. For sintering, a binding material containing glass is used to package the cathode structure 20 and the anode structure 10.

The benefits of the FED structure of the present invention are described in the following. The manufacturing process of the insulation supporting device is simple and can be manufactured independently. Additionally, the structure of the present invention can be manufactured without using the supporting post placing machine. The process is very simple for the insulation supporting machine. Further, the major benefit of the main feature of the reflection layer on the insulation supporting device is to reflect the light (deflected or reversed) emitted from the phosphors layer. The brightness can be raised with an obvious period.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended

We claim:

1. A field emission display with a reflection layer, comprising:

an anode structure having a phosphors layer;

a cathode structure having a nano-carbon-tube layer; and an insulation supporting device located between the anode structure and cathode structure, having the reflection layer facing the phosphors layer to reflect light emitted from the phosphors layer.

2. The emission display with the reflection layer as claimed in claim 1, wherein the cathode structure comprises a gate electrode layer between the nano-carbon-tube layer and the insulation supporting device.

3. The emission display with the reflection layer as claimed in claim 1, wherein the phosphors layer is formed by screen printing or spray coating.

4. The emission display with the reflection layer as claimed in claim 1, wherein the nano-carbon-tube layer is formed by screen printing or spray coating.

5. The emission display with the reflection layer as claimed in claim 1, wherein the nano-carbon-tube layer comprises a property-improved nano-carbon tube with a high rate of electron emission efficiency.

6. The emission display with the reflection layer as claimed in claim 1, wherein the insulation supporting device has a plurality of holes and every nano-carbon-tube layer in cell shape is placed in the holes.

7. The emission display with the reflection layer as claimed in claim 6, further comprising an interference rib placed in the insulation supporting device and the anode structure, the interference rib forming many air (vacuum) communication paths to connect to every hole.

8. The emission display with the reflection layer as claimed in claim 1, wherein the reflection layer is made of aluminum or chromium.

9. The emission display with the reflection layer as claimed in claim 7, wherein the insulation supporting device is made of glass with a thermal expansion modulus of about $82\times10^{-7}$–$86\times10^{-7}$/° C.

10. The emission display with the reflection layer as claimed in claim 1, wherein a binding material containing glass is used for packaging of the cathode structure and the anode structure.

* * * * *